US011733012B1

(12) United States Patent
Nelson

(10) Patent No.: US 11,733,012 B1
(45) Date of Patent: Aug. 22, 2023

(54) SOLID CORE LESS-LETHAL PROJECTILE

(71) Applicant: UMAREX USA, INC., Fort Smith, AR (US)

(72) Inventor: Darren Nelson, Malvern (ZA)

(73) Assignee: UMAREX USA, Inc., Fort Smith, AR (US)

( * ) Notice: Subject to any disclaimer, the term of this patent is extended or adjusted under 35 U.S.C. 154(b) by 0 days.

(21) Appl. No.: 18/111,559

(22) Filed: Feb. 18, 2023

Related U.S. Application Data

(60) Provisional application No. 63/439,152, filed on Jan. 16, 2023.

(51) Int. Cl.
*F42B 12/46* (2006.01)

(52) U.S. Cl.
CPC ..... *F42B 12/46* (2013.01)

(58) Field of Classification Search
CPC ..... F42B 12/46
USPC ..... 102/370
See application file for complete search history.

(56) References Cited

U.S. PATENT DOCUMENTS

| | | | | |
|---|---|---|---|---|
| 3,897,732 | A | 8/1975 | Atkins et al. | |
| 4,664,664 | A | 5/1987 | Drake, Jr. | |
| 5,009,165 | A | 4/1991 | Morris | |
| 5,393,054 | A | 2/1995 | Rouffer | |
| 5,649,488 | A | 7/1997 | Morrison et al. | |
| 7,194,960 | B2 | 3/2007 | Vasel et al. | |
| 7,331,293 | B2 | 2/2008 | Saxby | |
| 7,455,015 | B2 | 11/2008 | Krstic | |
| 7,690,311 | B1 * | 4/2010 | Cronemberger | F42B 12/40 102/512 |
| 7,930,977 | B2 | 4/2011 | Klein | |
| 7,934,454 | B2 | 5/2011 | Campo et al. | |
| 8,528,481 | B2 | 9/2013 | Scarr | |
| 9,212,876 | B1 * | 12/2015 | Kostka | F42B 12/22 |
| 9,587,918 | B1 * | 3/2017 | Burrow | F42B 12/78 |
| 10,295,291 | B2 | 5/2019 | Ellis | |
| 11,009,321 | B2 | 5/2021 | Buys | |
| 2007/0054762 | A1 | 3/2007 | Tocco | |
| 2012/0216699 | A1 * | 8/2012 | Fanucci | F42B 12/06 86/52 |

(Continued)

FOREIGN PATENT DOCUMENTS

| | | | | |
|---|---|---|---|---|
| WO | WO-2006031246 A1 * | 3/2006 | | F42B 12/74 |
| WO | WO 2012/012242 | 1/2012 | | |

*Primary Examiner* — Samir Abdosh
(74) *Attorney, Agent, or Firm* — Eric B. Fugett; Mark A. Pitchford; Pitchford Fugett, PLLC

(57) ABSTRACT

A solid core less-lethal projectile is a frangible projectile which generally includes a hollow body, a solid core, a support structure, and a payload material. The hollow body can be formed by two hollow hemispherical bodies that are joined. The hollow body defines a closed interior cavity in which the core is contained. The support structure is disposed inside the cavity. The support structure can be a plurality of ribs configured to confine the core at a center of the cavity and space the core from the sidewalls of the hollow body. The ribs can protrude from an interior surface the hollow body to the core. The ribs can extend centripetally from the interior surface to the core. The payload material substantially fills the cavity around the core and the ribs. The core is configured to stabilize the projectile during flight toward a target. The core can be a spherical metallic ball.

22 Claims, 4 Drawing Sheets

(56) References Cited

U.S. PATENT DOCUMENTS

| | | | | |
|---|---|---|---|---|
| 2014/0261045 | A1* | 9/2014 | Scott | F42B 12/54<br>102/502 |
| 2015/0268019 | A1* | 9/2015 | Amick | F42B 12/74<br>102/439 |
| 2016/0015499 | A1* | 1/2016 | Scott | F42B 7/08<br>604/130 |
| 2019/0257629 | A1* | 8/2019 | Sloff | F42B 33/14 |
| 2020/0166317 | A1* | 5/2020 | Stenzel | F42B 12/367 |
| 2020/0256654 | A1* | 8/2020 | Burrow | C22C 1/0458 |
| 2021/0108903 | A1* | 4/2021 | Folaron | F42B 12/34 |
| 2022/0341718 | A1* | 10/2022 | Jones | F42B 12/78 |

* cited by examiner

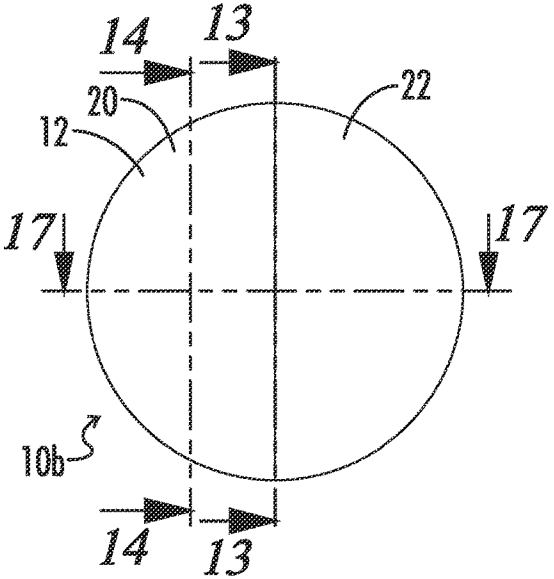
FIG. 12
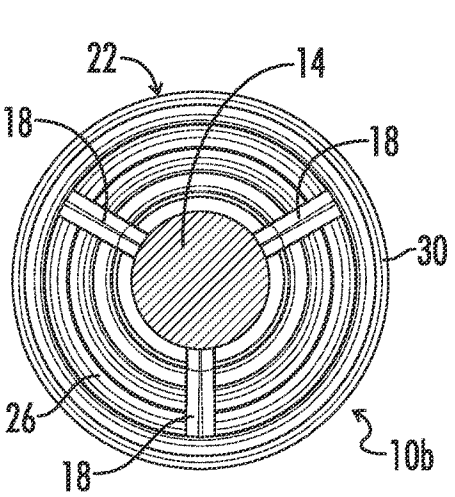
FIG. 13
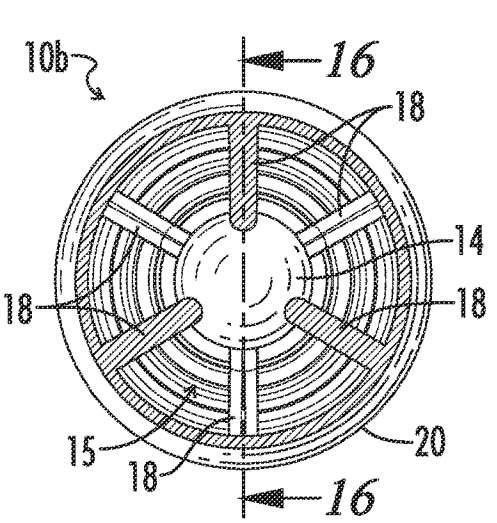
FIG. 14
FIG. 15
FIG. 16
FIG. 17

SOLID CORE LESS-LETHAL PROJECTILE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to U.S. Provisional Patent Application No. 63/439,152, filed on Jan. 16, 2023 and entitled "SOLID CORE LESS-LETHAL PROJECTILE," the entirety of which is hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

Weapons designed to minimize injury or death are widely known as "non-lethal," or more accurately, "less-lethal" weapons. Ranged less-lethal weapons typically use one or more compressed gasses as a propellant to fire or launch projectiles specifically designed to mark, elicit behavioral modification from, or even incapacitate a target without the typically lethal or permanent lasting effects of conventional firearms loaded with traditional metal ammunition. Like the weapons from which they are launched, such projectiles are known as "less-lethal" projectiles. Less-lethal projectiles are used around the world by civilians, law enforcement, and military personnel in a wide variety of applications, including self-defense, shooting sports and games, training, riot control, crowd control, prisoner control, and area denial, to name but a few.

Numerous types of less-lethal projectiles are known. These include rubber bullets, bean bag rounds, paintballs, and pepper spray projectiles, among others. Rubber bullets and bean bag rounds tend to be purely kinetic projectiles which function by delivering a blunt impact that actuates pain receptors in a living target to elicit behavioral change and some degree of incapacitation. By contrast, paintballs are light-weight, spherical gelatin capsules containing primarily polyethylene glycol, other non-toxic and water-soluble substances, and dye. The gelatin shell of a paintball is designed to break upon impact and release the paint contained therein, thereby marking the target with the dye. Although paintballs do typically cause some degree of physical discomfort upon impact, they are primarily used by civilians and law enforcement alike for target marking purposes, whether in furtherance of recreational or policing activities.

Unlike paintballs, pepper spray projectiles are frangible projectiles comprising a hollow shell or capsule which contains a chemical irritant designed to irritate the eyes and nose in a manner similar to pepper spray. Widely known as "pepper balls," pepper spray projectiles are most often spherical, but can also come in other shapes. Pepper balls are most commonly manufactured in .68 caliber so as to be compatible with currently available paintball guns (also known as "markers"), although other calibers of pepper ball, including .50 caliber, are available. The irritant payload is usually a flowable powder or a liquid, but can also be a gel, gas, or aerosol. For example, many available pepper balls are substantially filled with powdered or liquid capsaicin, the active ingredient in pepper spray, or some derivative or analog thereof. Other forms of pepper ball projectiles include those with an inert dummy payload used for training and testing purposes. Pepper balls can be and are typically fired at a higher velocity than paintballs because the shells of pepper balls are not made from gelatin, but rather a thicker, rigid frangible plastic. This helps the pepper balls fly straighter and farther, thereby providing better accuracy and range than paintballs. Pepper balls are immediately painful on impact with organic tissue, at which point the shells thereof are intended to break open and disperse the irritant with similar effect to aerosol-delivered pepper spray.

However, pepper spray projectiles of all shapes and sizes are notoriously inaccurate and do not reliably break upon impact with soft tissue or clothing, which dramatically limits their effective range and usefulness. This is at least partially because current manufacturing techniques do not allow for the shell or capsule of a pepper spray projectile to be completely filled with the irritant payload. The unavoidable result is that at least a small amount of empty void space remains inside the shell or capsule. This disadvantageously allows the flowable payload to move around inside the projectile, which not only creates imbalance and prevents the projectile from flying straight when shot at a target, but also cushions the impact and inhibits breaking. Because the irritant payload must contact the eyes, nose, or mouth of the target to have the intended effective, these drawbacks combine to severely limit the usefulness of pepper spray-type projectiles to applications where the shooter will be undesirably close to the potential target(s) and/or the target(s) are not likely to be wearing thick clothing or protective gear.

Accordingly, what is needed are improvements in less-lethal projectiles.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

The present invention provides a novel less-lethal projectile for firearms. The projectile includes a frangible hollow body or shell containing a solid core held in position at a center thereof and spaced from the sidewalls of the hollow body by internal support structures. The solid core and the support structures are surrounded by a flowable payload material, which can be an irritant compound. The solid core is formed from a material that is denser than the hollow body or shell, the payload material, and the support structures so that the core defines the center of mass of the projectile and stabilizes the projectile during flight to provide improved accuracy and range. The core also generates a secondary "failsafe" impact that unfailingly bursts the hollow body and disperses the payload material around the point of impact against a wider variety of targets, including soft tissues and thick clothing, thereby providing increased frangibility, reliability, and versatility relative to currently available frangible less-lethal projectiles.

Accordingly, in one aspect, the invention provides a frangible projectile comprising a hollow body defining a closed interior cavity, a solid core contained within the cavity and configured to stabilize the projectile during flight toward a target, a support structure inside the cavity configured to confine the core at a center of the cavity, and a payload in the cavity with the core and the support structure.

In another aspect, the invention provides a frangible projectile comprising a hollow hemispherical first body including a substantially concave first surface; a hollow hemispherical second body including a substantially concave second surface, the second body joined to the first body such that the joined first and second bodies define a closed interior cavity; a plurality of first ribs protruding from the first surface of the first body; a plurality of second ribs protruding from the second surface of the second body; a spherical metallic ball contained within the cavity; and a payload substantially filling the cavity around the ball and the ribs; wherein the ribs are configured to confine the ball at a center of the cavity and space the ball from the first and second bodies.

In yet another aspect, the invention provides a frangible projectile comprising a spherical shell defining a closed interior cavity, a spherical metallic ball contained within the cavity and spaced from the shell a plurality of ribs spaced around an interior surface of the shell, the ribs extending centripetally from the interior surface to the ball, and a payload substantially filling the cavity around the ball and the support structure.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

FIG. 12 is a side view of the projectile of FIG. 11 showing the projectile in an upright position.

FIG. 13 is a sectional view taken along line 13-13 of FIG. 12.

FIG. 14 is a sectional view taken along line 14-14 of FIG. 12.

FIG. 15 is a perspective view of the projectile of FIG. 14.

FIG. 16 is a sectional view taken along line 16-16 of FIG. 14.

FIG. 17 is a sectional view taken along line 17-17 of FIG. 12.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figures 1, 2:
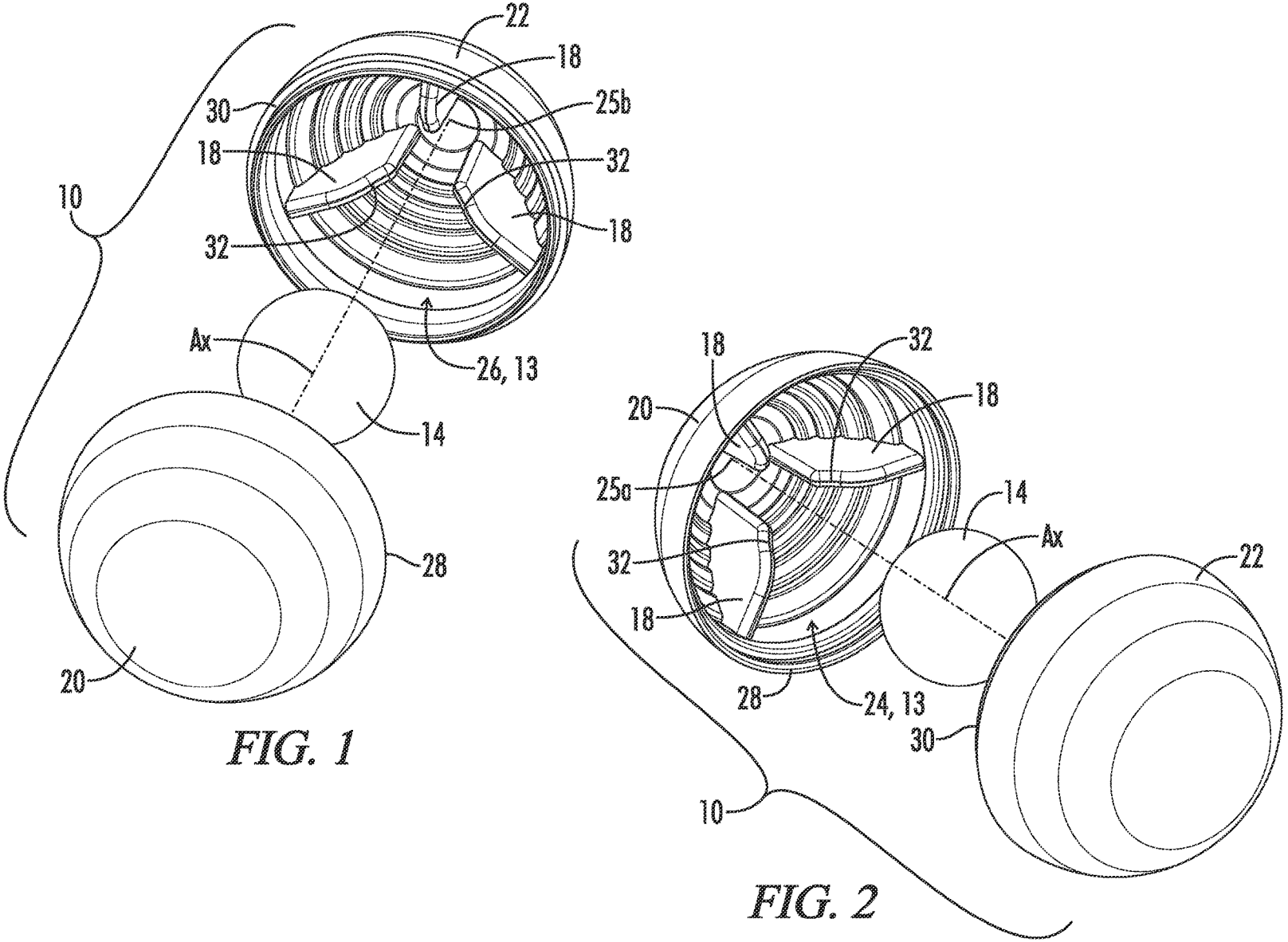
FIG. 1 is an exploded perspective view of a solid core frangible projectile constructed in accordance with an embodiment of the present invention. The projectile cavity is shown empty with the payload material omitted for clarity.
FIG. 2 is another exploded perspective view of the projectile of FIG. 1.
Figure 5:
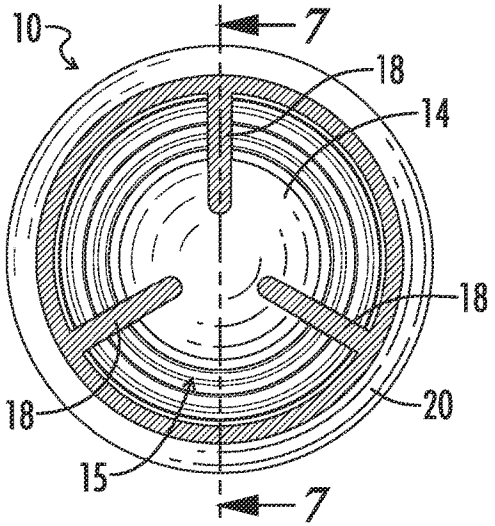
FIG. 5 is a sectional view taken along line 5-5 of FIG. 3.
Figure 4:
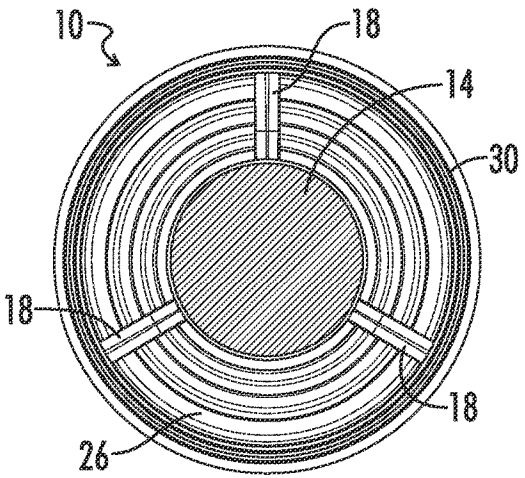
FIG. 4 is a sectional view taken along line 4-4 of FIG. 3. The portion of the left hemispherical body appearing in FIG. 3 on the right side of line 4-4 is omitted.
Figure 3:
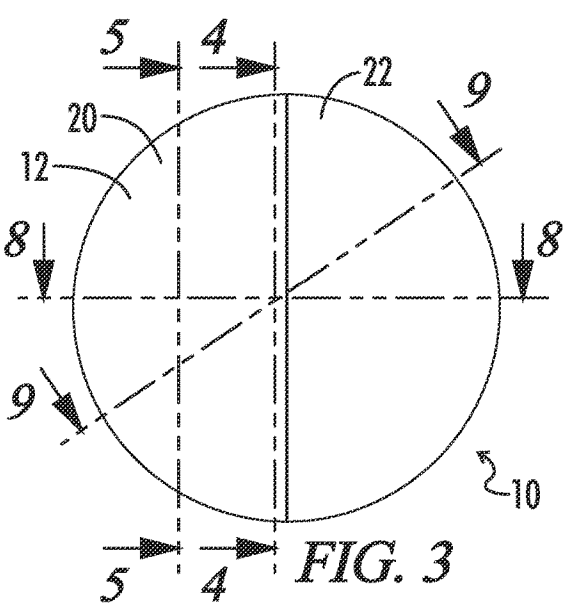
FIG. 3. is a side view of the projectile of FIG. 1 showing the projectile in an upright position.

As described herein, an "upright" position of a projectile is considered to be the position when the axis of symmetry of the projectile (or, in some embodiments, an axis about which the projectile is separable into two substantially identical bodies) is in a generally vertical orientation as depicted in, for example, FIG. 3. As used herein, the terms "aft" and "rear" means in a direction toward a rear end of a weapon, while the terms "front" and "forward" means in a direction extending away from the rear of the weapon toward the muzzle of the weapon. In some cases, the term "forward" can also mean forward beyond the muzzle of the weapon. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

The term "substantially" as used herein means what is considered normal or possible within the limits of applicable industry accepted manufacturing practices and tolerances. For example, the phrase "substantially full," as used herein, means that something contains as much or as many as is normal or possible within the limits of industry accepted manufacturing practices and tolerances. Similar, the phrases "substantially fills" and "substantially filling," as used herein, means that something is made to fill or occupy as much of something else (such as a space or a container) as is normal or possible within the limits of applicable industry accepted manufacturing practices and tolerances.

Referring to FIGS. 1-10, there is shown an embodiment of a solid core less-lethal frangible projectile 10. The projectile 10 generally includes a hollow body 12, a solid core 14, a payload material 16, and one or more support structures 18. The hollow body 12 has an interior surface 13 and defines a single, continuous closed (e.g., sealed) interior cavity 15. The solid core 14 is contained within the cavity 15. The support structures 18 inside the cavity 15 space the core 14 from the interior surface or the sidewalls of the hollow body 12 and hold or confine the core 14 at a center 17 of the cavity 15. The payload material 16 substantially fills the cavity 15 around the core 14 and the support structures 18.

The core 14 is formed from a denser material than the hollow body 12, the payload material 16, and the support structures 18. As such, the core 14 can weigh more than each of the hollow body 12, the payload material 16, and the support structures 18. For example, in the depicted embodiment, the solid core 14 is a spherical steel ball 14. However, in other embodiments, the core can be formed from one or more other metallic materials, such as iron, copper, or lead. Alternately, in some embodiments, the solid core 14 can be formed from any non-metallic material(s) with greater density than the material(s) from which the hollow body 12, the payload material 16, and the support structures 18 are formed. However, the inventor has determined that use of common metallic materials advantageously enables the diameter of the core 14 to be less than half the diameter D of the hollow body 12, which provides appreciable weight savings for users without limiting functionality. To illustrate, in one embodiment, the hollow body 12 and support structures 18 can collectively weigh about 0.8 grams, the core 14 can be a steel ball that is 8 mm in diameter and weighs about 2.12 grams, and the payload can be an irritant powder weighing about 1.58 grams. In such embodiment, the assembled projectile 10 can be .68 caliber and weigh about 4.5 grams.

The mass and position of the core 14 at the center of the hollow body 12 effectively nullifies the effect of any imbalance in the projectile 10 which may otherwise result from non-uniformity in the payload material 16 itself or the cavity 15 being incompletely filled with the payload 16. As such, the core 14 defines the center of mass of the projectile 10 and stabilizes the projectile 10 during flight when the projectile 10 is launched or fired toward a target. In this way, the disclosed arrangement of the core 14 within the hollow body 12 accurizes the less-lethal projectiles 10 disclosed herein. Solid core less-lethal projectiles 10 of the present invention thus provide greater accuracy and range than other currently available less-lethal projectiles.

In addition, the increased weight and density of the core 14 relative to the hollow body 12, the payload 16, and the support structure 18, combined with the positioning of the core 14 at the center 17 of the cavity 15, allows the core 14 to move within the cavity 15 upon impact of the projectile 10 with a target, crush any intervening support structure(s) 18, and apply a force to whichever side of the hollow body 12 first contacts the target. This generates a secondary "failsafe" impact sufficient to rupture the hollow body 12 and disperse the payload material 16 around the point of impact in the event that the initial contact of the projectile 10 with the target does not rupture the hollow body 12. Consequently, projectiles 10 of the present invention reliably burst upon impact against a wider variety of targets, including soft tissues and thick clothing. In this way, solid core projectiles 10 of the present invention provide increased frangibility, reliability, and versatility relative to currently available frangible less-lethal projectiles.

Turning again to FIGS. 1-10, in an embodiment, the hollow body 12 is a spherical frangible shell 12 defining interior cavity 15. The hollow body 12 is formed from two hemispherical bodies 20, 22 that are joined together. A diameter D of the hollow body 12 and the cavity 15 is proximate to where the bodies 20, 22 are joined. Each hemispherical body 20, 22 respectively includes a concave surface 24, 26, a rim 28, 30, and a pole 25*a*, 25*b*. The pole 25*a*, 25*b* on each body is concentrically centered with the respective rim 28, 30. The poles 25*a*, 25*b* define an axis Ax of the projectile 10 extending from the pole 25*a* of the first body 20 to the pole 25*b* of the second body 22.

Figure 8:
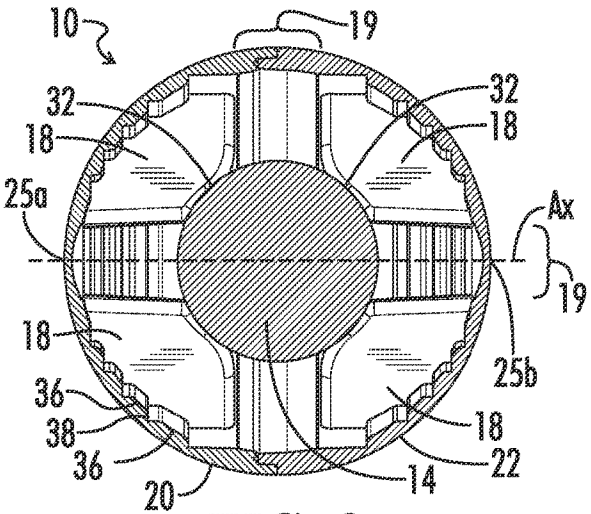
FIG. 8 is a sectional view taken along line 8-8 of FIG. 3.
Figure 7:
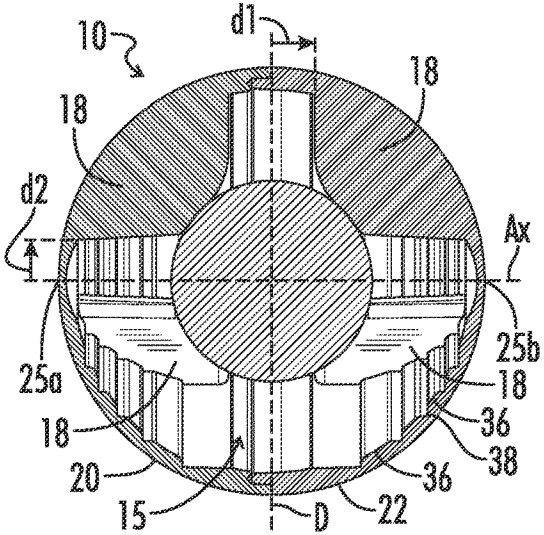
FIG. 7 is a sectional view taken along line 7-7 of FIG. 5.
Figure 6:
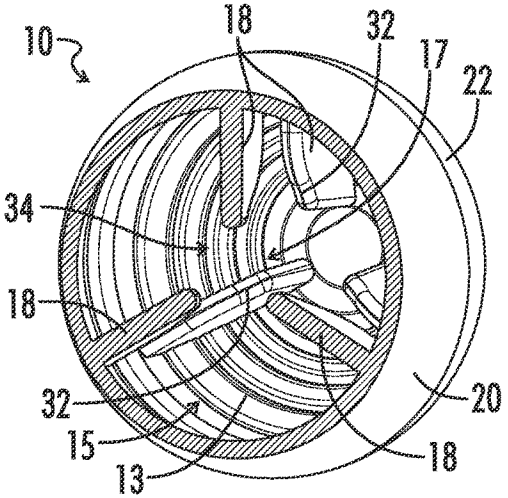
FIG. 6 is a perspective view of the projectile of FIG. 5 with the solid core omitted.
Figure 10:
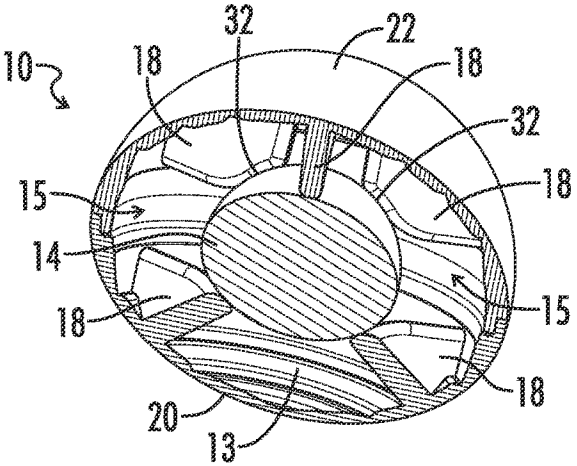
FIG. 10 is a perspective view of the projectile of FIG. 9A.
Figure 11:
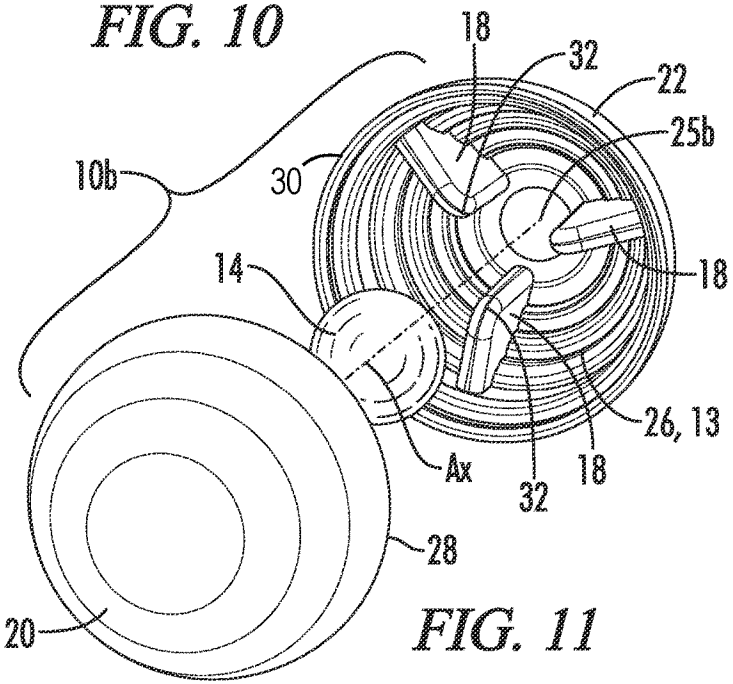
FIG. 11 is an exploded perspective view of a solid core frangible projectile constructed in accordance with another embodiment of the present invention. The projectile cavity is shown empty with the payload material omitted for clarity.
Figure 9A:
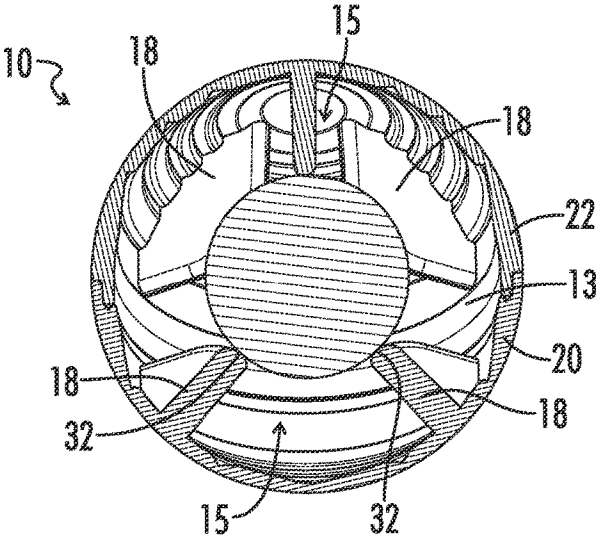
FIG. 9A is a sectional view taken along line 9-9 of FIG. 3.
Figure 9B:
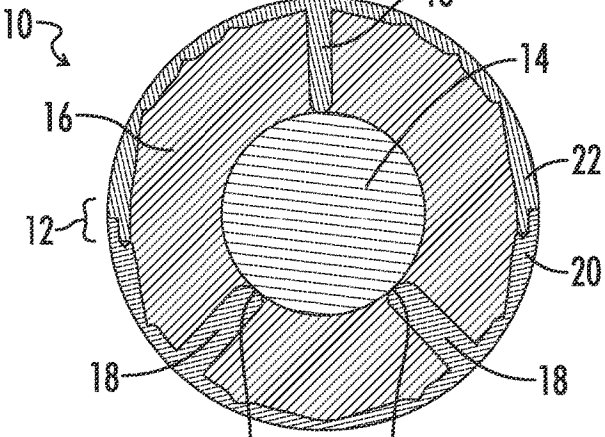
FIG. 9B is another sectional view taken along line 9-9 of FIG. 3 showing the projectile cavity filled with a payload material.

The support structures 18 of the hollow body 12 are a plurality of thin ribs 18 having a triangular profile. Each hemispherical body 20, 22 has three ribs 18 formed thereon. The ribs 18 are symmetrically spaced around the concave surfaces 24, 26 of each respective hemispherical body 20, 22. The ribs 18 do not extend beyond the rim 28, 30 of either hemispherical body 20, 22. Instead, the ribs 18 of each hemispherical body 20, 22 are spaced a first distance d1 along the respective concave surface 24, 26 from the respective rim 28, 30 of each body 20, 22. As such, the ribs 18 of the first hemispherical body 20 are spaced from the ribs 18 of the second hemispherical body 22 about the diameter D of the cavity 15 or shell 12. The ribs 18 of each hemispherical body 20, 22 are also spaced a second distance d2 along the respective concave surface 24, 26 from the respective pole 25*a*, 25*b* of each body 20, 22. In this way, the ribs 18 of each hemispherical body 20, 22 are symmetrically arranged about the respective pole 25*a*, 25*b* of each body 20, 22. Furthermore, the first distance d1 is equal to the second distance d2. As a result, the resulting gaps 19 formed between adjacent and opposing ribs 18 are substantially the same size, as best shown in FIG. 8. This in turns creates uniformity among the ribs 18 so that the core 14 can reliably and consistently break the hollow body 12 regardless of which side of the projectile 10 first contacts the target.

The ribs 18 extend centripetally from the concave surfaces 24, 26 of each hemispherical body 20, 22 to the solid core 14. Each rib 18 includes a free end which defines a bearing surface 32 in contact with the core 14. The bearing surfaces 32 of the ribs 18 contact the core 14 at six different symmetrically spaced locations around the core 14 so as to confine the core 14 in place at the center 17 of the cavity 15. As such, the bearing surfaces 32 collectively circumscribe the core 14 so as to define a pocket or seat 34 in which the core 14 is received or seated at the center 17 of the cavity 15 between sidewalls of the body 12. In this way, the ribs 18 space the core 14 from the surfaces 24, 26 of the two hemispherical bodies 20, 22. The bearing surfaces 32 of the ribs 18 are concave in order to better grip the core 14 and confine or hold the core 14 steady at the center 17 of the cavity 15. Concave bearing surfaces 32 can be particularly advantageous for use in projectiles 10 formed in large less-lethal projectile calibers (e.g., .68 caliber and above) because the concavity helps prevent the core 14 from slipping off of a rib 18 as the projectile 10 flexes and/or spins whiles traveling down the barrel of an air gun or other launcher immediately upon firing.

As best shown in FIG. 8, each hemispherical body 20, 22, has a non-uniform wall thickness. More specifically, the concave surface 24, 26 of each hemispherical body 20, 22 includes a plurality of rings of stepped ridges 36 and valleys 38 arranged concentrically around the pole 25*a*, 25*b* of each respective body 20, 22. The ridges 36 and valleys 38 on each hemispherical body 20, 22 are symmetrical about the diameter D of the hollow body 12. The width of each ridge 36 and valley 38 decreases with each ring of ridges 36 and valleys 38 nearer the pole 25*a*, 25*b* of the respective hemispherical body 20, 22. The rings of ridges 36 and valleys 38 are configured to create areas of weakness in the hollow body 12 which will flex and cause the body 12 to burst when a projectile 10 contacts a target.

In order to balance the brittleness and frangibility of the hollow body 12 with sufficient durability to enable the projectile 10 to be propelled at high velocity out of the barrel of an air gun or other launching device without breaking, the ribs 18 on each hemispherical body 20, 22 are arranged to extend across the rings of ridges 36 and valleys 38 on the respective surface 24, 26 of the corresponding body 20, 22. The ribs 18 on the first hemispherical body 20 align with the ribs 18 on the second hemispherical body 22 along the axis Ax. Although ribs 18 aligned along the axis Ax can optimally balance a projectile 10 for long range precision shooting, such axial alignment is unnecessary and has no noticeable impact on projectile stability, accuracy, or frangibility in all short to medium range applications in which less-lethal projectiles are currently employed.

Turning now to FIGS. 11-17, there is shown another embodiment of a less-lethal frangible projectile 10*b*. Frangible projectile 10*b* depicted in FIGS. 11 through 17 is identical in all aspects of form and function to frangible projectile 10 depicted in FIGS. 1 through 10 except as subsequently described below. Specifically, the bearing surfaces 32 on the triangular ribs 18 of projectile 10*b* are convex instead of concave. Convex bearing surfaces 32 can be more equally effective at retaining the core 14 at the center of the cavity 15 at lesser manufacturing cost in small caliber projectiles (e.g., less than .68 caliber) where the ratio of core size to cavity space around the core is lower. Additionally, the ribs 18 on the first hemispherical body 20 do not align with the ribs 18 on the second hemispherical body 22 along the axis Ax. Instead, the ribs 18 on the first hemispherical body 20 are misaligned with the ribs 18 on the second hemispherical body 22. Moreover, although the ribs 18 on the first hemispherical body 20 are depicted as symmetrically positioned with respect to the ribs 18 on the second hemispherical body 22 (see FIG. 14), it is to be understood that in some embodiments the ribs 18 on the first hemispherical body 20 can be asymmetrically positioned with respect to the ribs 18 on the second hemispherical body 22 as long as the number and placement of ribs 18 are sufficient to confine the core 14 at the center 17 of the cavity 15 of the hollow body 12.

The payload material 16 used in projectiles 10, 10*b* disclosed herein can include one or more of a liquid, a gel, an aerosol, or a granular or particulate material. For example, in some embodiments, the payload 16 can be include a powder containing an irritant such as capsaicin, oleoresin *capsicum*, pelargonic acid vanillylamide (PAVA), and the like, or analogs or derivatives thereof. In other embodiments, the payload 16 can be an inert, non-irritant payload chalk or talcum powder. In some embodiment, the payload 16 can be paint or dye. In additional embodiments, the payload 16 can include a paint or dye and a particulate substance, such as sand. It should be understood that although the projectiles 10, 10*b* disclosed herein are specifically designed to function as described with flowable payloads such as liquids, powders, and granular or particulate materials, the disclosed projectiles are equally functional with non-flowable but relatively brittle payloads such as compacted or compressed powders or other particulate materials.

All projectiles described herein can manufactured using various processes known in the art for the production of other less-lethal projectiles such as pepper spray projectiles, pepper balls, and paint balls, including for example, injection mold, 3D printing, and the like. All projectiles described herein can be manufactured in any caliber or diameter. Calibers in which the projectiles 10, 10*b* disclosed herein are believed to be especially effective include but are not limited to 0.50 and .68 caliber. Suitable materials from which the hollow body 12, including each hemispherical body 20, 22, described herein can be manufactured are known in the art and include various brittle or frangible polymeric materials (e.g., general purpose polystyrene, and the like) and composites of one or more polymeric materials and one or more metallic materials. Likewise, the supporting structures 18, including exemplar ribs 18, disclosed herein can be formed from the same or different materials than the hollow body 12 and joined hemispherical bodies 20, 22.

Although embodiments of the present invention have been described in detail, it will be understood by those skilled in the art that various modifications can be made therein without departing from the spirit and scope of the invention as set forth in the appended claims. For example, although the projectiles 10, 10*b* disclosed herein are depicted as spheres, it is to be understood that the term "spherical" as used herein encompasses but is not limited to spheres. Rather, the term "spherical" as used herein encompass shapes which are generally or roughly round, including spheroids and many-sided polyhedrons suitable for use as projectiles, such as icosahedron and zocchihedron. The related term "hemispherical" should be similarly understood as encompassing shapes which are half of a sphere or other "spherical" shape. It is also to be understood that in other embodiments, non-spherical projectiles can be manufactured in accordance with the principles of the present invention. All such embodiments are considered within the scope of the present invention.

Additionally, in some embodiments, the supporting structures 18 can be integrally formed with the hollow body 12 or one or both of the hollow hemispherical bodies 20, 22. In other embodiments, the support structure 18 can be formed as a separate member or component from the hollow body 12 and the hemispherical bodies 20, 22 and inserted into the cavity 15 with the core 14. In additional embodiments, the support structure 18 can be a separate unitary piece having a form or shape different than that of ribs 18 as depicted in the instant figures. For example, in one embodiment, a single supporting structure 18 having the general form of a honey comb can replace all six ribs 18 depicted in projectiles 10 and 10*b*. Other embodiments exist.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A frangible projectile, comprising:
a hollow body defining a closed interior cavity;
a solid core contained within the cavity;
a support structure in the cavity configured to confine the core at a center of the cavity; and
a payload in the cavity with the core and the support structure;
wherein the core is configured to stabilize the projectile during flight toward a target.

2. The projectile of claim 1, wherein:
the support structure is a plurality of spaced support structures;
each support structure includes a bearing surface; and
the bearing surfaces circumscribe the core.

3. The projectile of claim 2, wherein:
at least one bearing surface is concave; or
the bearing surfaces contact the core at six or more different locations around the core.

4. The projectile of claim 1, wherein the core is denser than the hollow body and the payload.

5. The projectile of claim 4, wherein the support structure is a plurality of spaced support structures extending centripetally from an interior surface of the hollow body to the core.

6. The projectile of claim 5, wherein:
each support structure includes a bearing surface; and
the bearing surfaces circumscribe the core.

7. The projectile of claim 6, wherein:
each support structure has a triangular profile; and
the core is received against the bearing surface of each support structure.

8. The projectile of claim 1, wherein:
the hollow body is spherical;
the core defines a center of mass of the projectile; and
the core is configured to rupture the hollow body and disperse the payload upon impact of the projectile with a target.

9. The projectile of claim 8, wherein:
the hollow body is two hollow hemispherical bodies joined together;
each hemispherical body has a non-uniform wall thickness;
the core is a spherical metallic ball; and
the payload includes a liquid, a gel, or a particulate material.

10. The projectile of claim 1, wherein:
the core has a first weight;
the hollow body and the support structure have a second weight;
the payload has a third weight;

the first weight is greater than the second weight; and the first weight is greater than the third weight.

11. A frangible projectile, comprising:

a hollow hemispherical first body including a concave first surface;

a hollow hemispherical second body including a concave second surface, the second body joined to the first body such that the joined first and second bodies define a closed interior cavity;

a plurality of first ribs extending from the first surface of the first body;

a plurality of second ribs extending from the second surface of the second body;

a spherical metallic ball contained within the cavity; and a payload substantially filling the cavity around the ball and the ribs;

wherein the ribs are configured to confine the ball at a center of the cavity and space the ball from the first and second surfaces.

12. The projectile of claim 11, wherein:

the first ribs are spaced around the first surface of the first body; and the second ribs are spaced around the second surface of the second body.

13. The projectile of claim 12, wherein:

the first ribs do not extend beyond a rim of the first body; and the second ribs do not extend beyond a rim of the second body.

14. The projectile of claim 12, wherein the first ribs are spaced from the second ribs across a diameter of the cavity.

15. The projectile of claim 14, wherein:

the first ribs are spaced a distance along the first surface from a pole of the first body;

the second ribs are spaced the distance along the second surface from a pole of the second body; and the first ribs are spaced the distance from the second ribs across the diameter.

16. The projectile of claim 11, wherein:

the first ribs extend centripetally from the first surface to the ball; and the second ribs extend centripetally from the second surface to the ball.

17. The projectile of claim 16 wherein:

the first ribs are symmetrically arranged about a pole of the first body; and the second ribs are symmetrically arranged about a pole of the second body.

18. The projectile of claim 11, wherein:

the first and second bodies define an axis extending from a pole of the first body to a pole of the second body; and the first ribs align with the second ribs along the axis.

19. The projectile of claim 11, wherein:

the first surface of the first body includes a plurality of ridges and valleys arranged concentrically around a pole of the first body;

the second surface of the second body includes a plurality of ridges and valleys arranged concentrically around a pole of the second body;

the first ribs extend across the ridges and valleys on the first surface; and the second ribs extend across the ridges and valleys on the second surface.

20. A frangible projectile, comprising:

a spherical polymeric shell defining a closed interior cavity;

a spherical metallic ball contained within the cavity and spaced from the shell;

a plurality of polymeric ribs spaced around an interior surface of the shell, the ribs extending centripetally from the interior surface to the ball; and a payload substantially filling the cavity around the ball and the plurality of ribs;

wherein the core is configured to stabilize the projectile during flight toward a target and rupture the shell and disperse the payload upon impact of the projectile with the target.

21. The projectile of claim 20, wherein:

each rib has a triangular profile defining a free end; and the free end of each rib includes a bearing surface which contacts the ball to thereby confine the ball at a center of the cavity.

22. The projectile of claim 20, wherein:

the interior surface of the shell includes a plurality of concentric ridges and valleys configured to weaken the shell; and the ribs extend across the concentric ridges and valleys.

* * * * *